US005931551A

United States Patent [19]

Wang

[11] Patent Number: 5,931,551

[45] Date of Patent: Aug. 3, 1999

[54] STORAGE CABINET WITH DETACHABLE SLIDING STORAGE BOXES

[76] Inventor: Wen-Tsan Wang, P.O. Box 82-144, Taipei, Taiwan

[21] Appl. No.: 09/086,351

[22] Filed: May 29, 1998

[51] Int. Cl.[6] ..... A47B 53/00

[52] U.S. Cl. ..... 312/258; 312/245; 312/265.6; 312/348.2; 312/348.6; 312/330.1

[58] Field of Search ..... 312/245, 246, 312/248, 265.6, 249.7, 249.1, 348.1, 348.2, 348.6, 265.5, 330.1, 258; 297/440.12

[56] References Cited

U.S. PATENT DOCUMENTS

| | | | |
|---|---|---|---|
| 3,443,851 | 5/1969 | Earl | 312/245 |
| 3,591,245 | 7/1971 | Allen | 312/258 |
| 3,837,719 | 9/1974 | Barron | 297/440.12 X |
| 4,382,640 | 5/1983 | Kashden | 312/258 X |
| 4,485,928 | 12/1984 | Staashelm | 312/246 X |
| 4,699,437 | 10/1987 | Genereaux | 312/246 X |
| 5,072,838 | 12/1991 | Price, Jr. et al. | 312/245 X |
| 5,649,751 | 7/1997 | Longhurst | 312/245 X |
| 5,682,623 | 11/1997 | Fenoglio | 297/440.12 X |

*Primary Examiner*—Peter M. Cuomo
*Assistant Examiner*—Stephen Vu
*Attorney, Agent, or Firm*—A & J

[57] ABSTRACT

A detachable storage box including a cabinet body defining a plurality of sliding chambers, the cabinet body having a hanging rod transversely disposed at a top side thereof for mounting inside a wardrobe, and a plurality of detachable sliding storage boxes respectively inserted into the sliding chambers, the storage boxes being respectively made by folding up a sheet element into shape.

1 Claim, 3 Drawing Sheets

STORAGE CABINET WITH DETACHABLE SLIDING STORAGE BOXES

BACKGROUND OF THE INVENTION

The present invention relates to a storage cabinet for keeping personal small items, and more particularly to such a storage cabinet which is comprised of a cabinet body having a transverse hanging rod for mounting inside a wardrobe, and a plurality of detachable storage boxes mounted in respective sliding storage chambers in the cabinet body.

U.S. patent application Ser. No. 09/009,419 filed on Jan. 20, 1998, disclosed a structure of detachable storage box for keeping personal small items. This structure of storage box is comprised of a box body, and a collapsible lattice type partition device mounted inside the box body and defining a plurality of separated open spaces for keeping small items. The box body is formed by folding up a sheet element into shape. When several storage boxes are used, and arranged in a stack, they may be forced to fall to the ground when vibrated.

SUMMARY OF THE INVENTION

The invention eliminates the aforesaid disadvantage. According to the present invention, the storage cabinet is comprised of a cabinet body defining a plurality of sliding chambers, and a plurality of detachable sliding storage boxes respectively inserted into the sliding chambers. The cabinet body comprises a hanging rod transversely disposed at the top for mounting inside a wardrobe. The storage boxes are respectively made by folding up a sheet element into shape, enabling panels of the sheet element to be fastened to one another by hook and loop materials.

DETAILED DESCRIPTION OF THE PREFERRED EMBODIMENT

Figure 3:
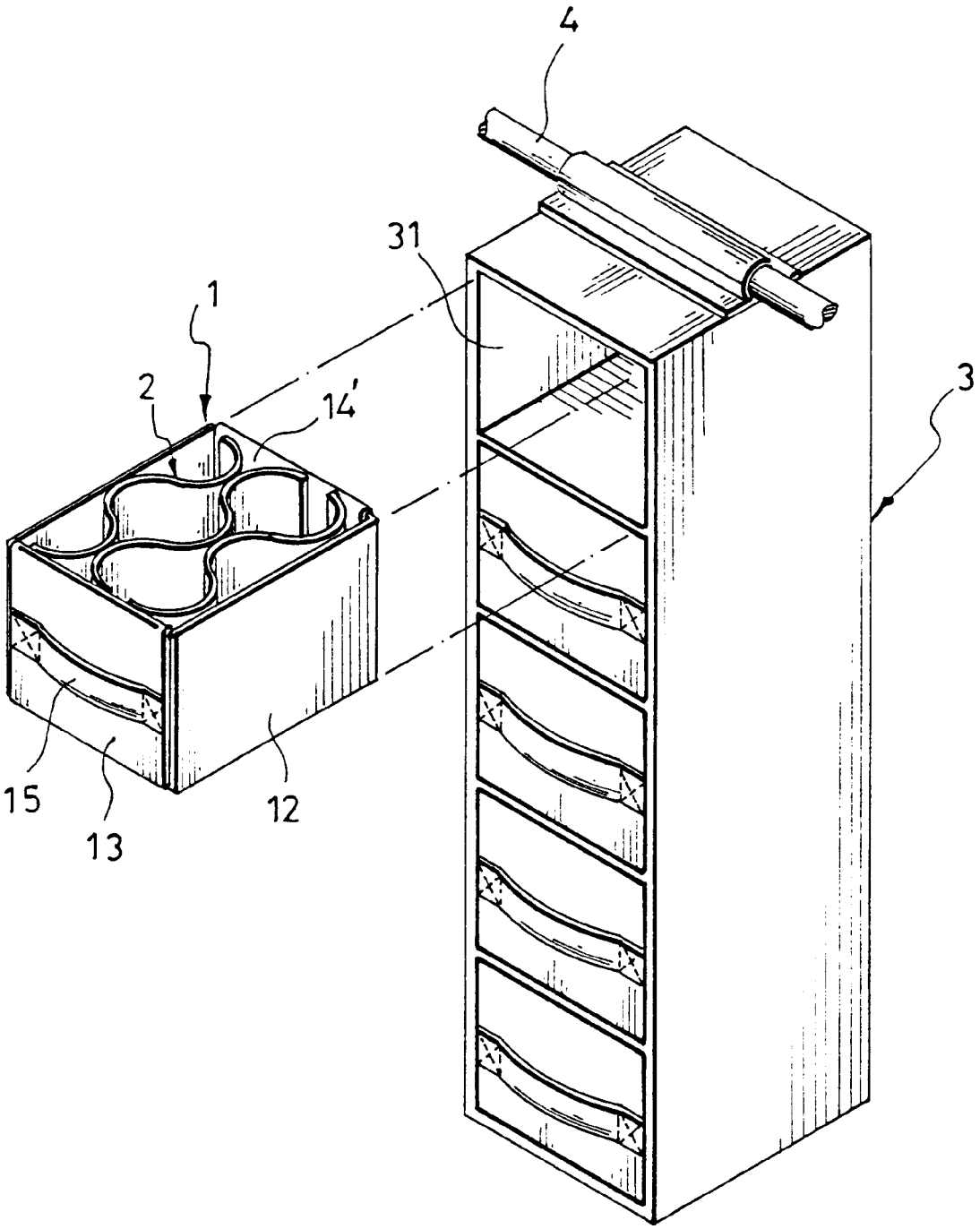
FIG. 3 is an exploded view of a storage cabinet according to the present invention.

Referring to FIG. 3, a storage cabinet in accordance with the present invention is generally comprised of a cabinet body 3 defining a plurality of sliding chambers 31, and a plurality of detachable storage boxes 1 respectively slidably inserted into the box chambers 31.

Figure 1:
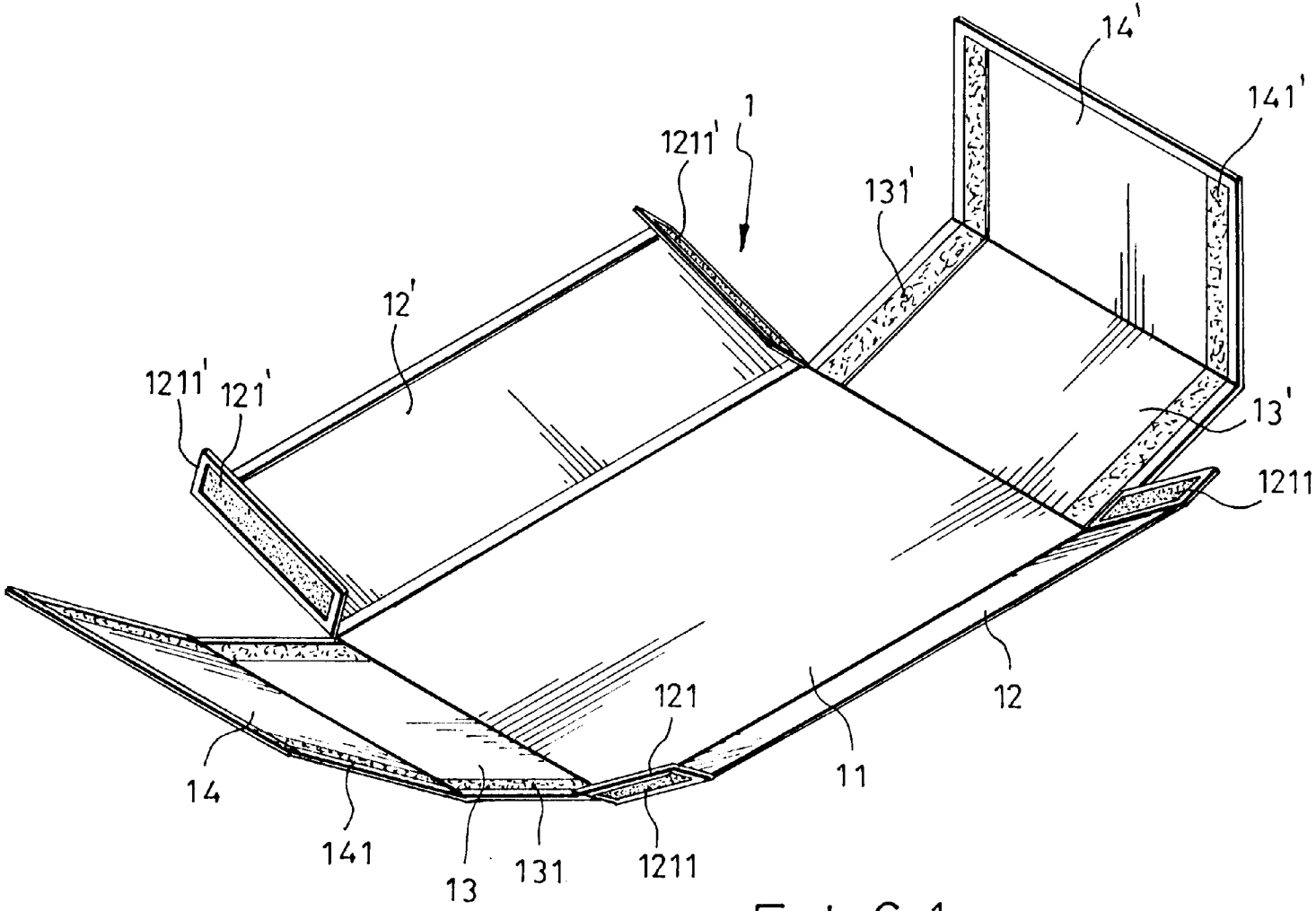
FIG. 1 is an extended out view of a box body for a detachable storage box according to the present invention.
Figure 2:
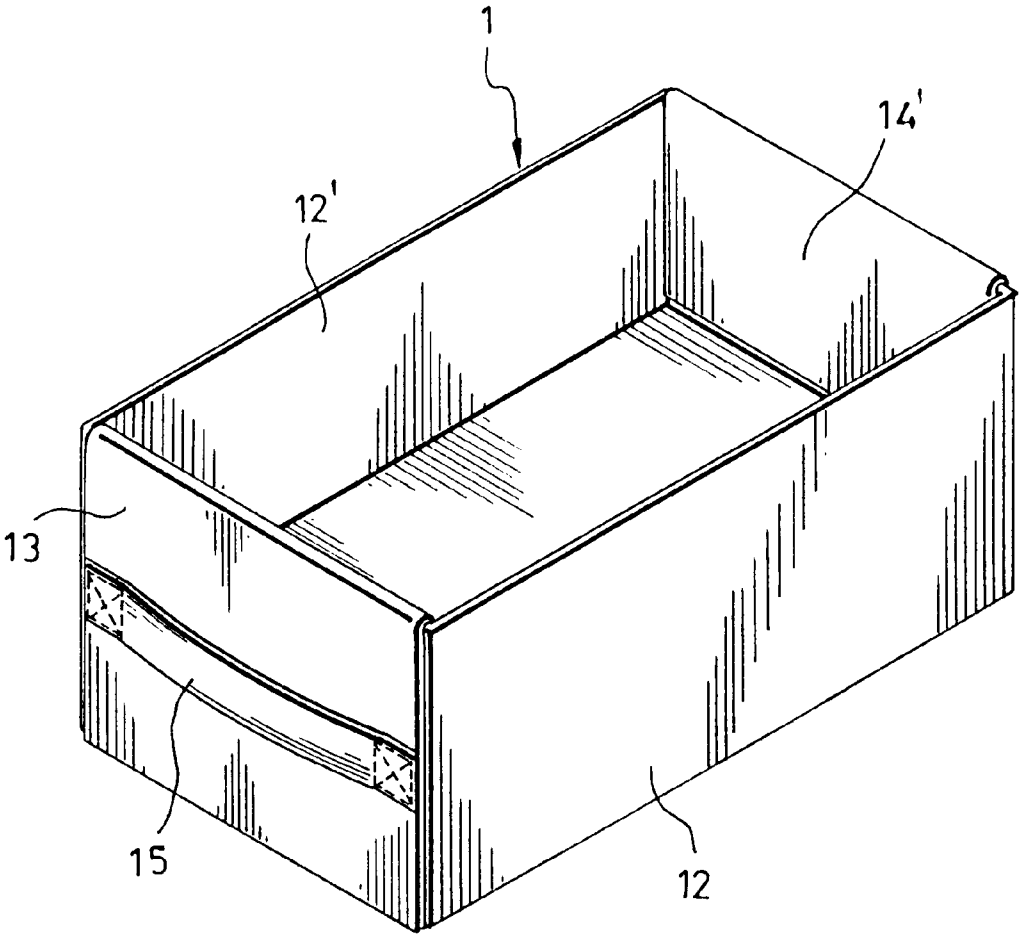
FIG. 2 is an assembly view of FIG. 1.

Referring to FIGS. 1 and 2 again, the detachable storage box 1 is made by folding up a sheet element into shape, comprising a rectangular bottom panel 11 having a front side and a rear side and two opposite lateral sides, a front panel 13 and a back panel 13' respectively extended from the front and rear sides of the rectangular bottom panel 11, two side panels 12;12' respectively extended from the two opposite lateral sides of the bottom panel 11, front and back flaps 14;14' respectively extended from the front and back panels

13;13' at one side remote from the bottom panel 11, two pairs of side flaps 121;121' respectively extended from the side panels 12;12' at two opposite sides adjacent to the bottom panel 12, and a handle 15 fastened to the front panel 13 at an outer side. The front panel 13 and the back panel 13' each have a pair of hook tapes 131, 131' bilaterally disposed at an inner side. The front and back flaps 14;14' each have a pair of hook tapes 141;141' bilaterally disposed at an inner side. The first side flaps 121 each have two loop tapes 1211 at both sides. The second side flaps 121' each have two loop tapes 1211' at both sides. The side panels 12;12' are inwardly folded up, then the side flaps 121;121' of the side panels 12;12' are respectively and inwardly folded up, and then the front panel 13 and the back panel 13' are respectively inwardly folded up, enabling the hook tapes 131;131' of the front and back panels 13;13' to be forced into engagement with the loop apes 1211;1211' at the outer sides of the side panels 12;12', and hen the front and back flaps 14;14' are respectively inwardly folded up, enabling the hook tapes 141;141' of the front and back flaps 14;14' to be forced into engagement with the loop tapes 1211;1211' at the inner sides of the side panels 12;12'. After the storage box 1 has been set up, a partition device 2 which is comprised of a plurality of cardboard sheets connected into a lattice structure, is put into the inside of the storage box 1. The partition device 2 divides the holding space of the storage box 1 into a plurality of small storage chambers for keeping small items.

Referring to FIG. 3 again, a hanging rod 4 is transversely fastened to the cabinet body 3 at the top for mounting inside a wardrobe.

What the invention claimed is:

1. A storage cabinet comprising:

a cabinet body defining a plurality of chambers, said cabinet body having a straight hanging rod transversely disposed at a top side thereof for mounting inside a wardrobe; and a plurality of detachable sliding storage boxes respectively inserted into said chambers, said storage boxes being respectively made by folding up a sheet element, each comprising a rectangular bottom panel having a front side and a rear side and two opposite lateral sides, a front panel and a back panel respectively extended from the front and rear sides of said rectangular bottom panel, two side panels respectively extended from the two opposite lateral sides of said bottom panel, a front flap and a back flap respectively extended from said front panel and said back panel at one side remote from said bottom panel, two pairs of side flaps respectively extended from said side panels at two opposite sides adjacent to said bottom panel, and a handle fastened to said front panel at an outer side, said side panels each having two loop tapes at both sides, said front panel and said back panel each having a pair of hook tapes bilaterally disposed at an inner side and fastened to a respective loop tape on said side flaps, said front and back flaps each having a pair of hook tapes bilaterally disposed at an inner side and fastened to a respective loop tape on said side flaps.

* * * * *